US007614501B2

(12) United States Patent
Palmer et al.

(10) Patent No.: US 7,614,501 B2
(45) Date of Patent: Nov. 10, 2009

(54) UTILITY AND PROTECTIVE PACKAGING SYSTEM

(75) Inventors: Christopher George Palmer, Pleasanton, CA (US); Edward Earnest Schlitt, Danville, CA (US)

(73) Assignee: Uneka Concepts, Inc., Pleasanton, CA (US)

( * ) Notice: Subject to any disclaimer, the term of this patent is extended or adjusted under 35 U.S.C. 154(b) by 167 days.

(21) Appl. No.: 11/687,526

(22) Filed: Mar. 16, 2007

(65) Prior Publication Data

US 2007/0221523 A1 Sep. 27, 2007

Related U.S. Application Data

(60) Provisional application No. 60/785,762, filed on Mar. 21, 2006.

(51) Int. Cl.

| | |
|---|---|
| ***B65D 81/02*** | (2006.01) |
| ***B65D 85/00*** | (2006.01) |
| ***B65D 85/30*** | (2006.01) |
| ***B65D 5/00*** | (2006.01) |

(52) U.S. Cl. ..... 206/521; 206/320; 206/592; 229/170

(58) Field of Classification Search ..... 206/521, 206/320, 592, 721, 725, 751, 769, 784, 583, 206/497, 594, 45.21, 586, 590; 229/112, 229/117.17, 120.11, 120.34, 122, 164, 165, 229/167, 178, 191, 120.28

See application file for complete search history.

(56) References Cited

U.S. PATENT DOCUMENTS

| | | | | |
|---|---|---|---|---|
| 2,864,545 | A * | 12/1958 | Royce | 229/120.34 |
| 3,368,735 | A * | 2/1968 | Levi | 206/424 |
| 3,994,399 | A | 11/1976 | Numata et al. | |
| 4,184,625 | A * | 1/1980 | Stollberg et al. | 206/521.1 |
| 6,474,473 | B2 | 11/2002 | Wong | |
| 6,675,970 | B1 * | 1/2004 | Nemoto | 206/521 |
| 6,997,323 | B2 | 2/2006 | Maresh et al. | |
| 7,296,680 | B2 * | 11/2007 | Yokawa | 206/521 |
| 2005/0023161 | A1 * | 2/2005 | Hsu | 206/320 |

* cited by examiner

*Primary Examiner*—Stephen Garbe
*Assistant Examiner*—Kaushikkumar Desai
(74) *Attorney, Agent, or Firm*—Michael J. Hughes

(57) ABSTRACT

A utility and protective packaging system (10) is provided for containing and protecting electronic component objects (14) such as digital video recorders during storage and shipping. The system (10) is originally constructed in a planar sheet (16) form which is then folded into a tray (12). The tray (12) is configured as a squat "I" shape with the object (14) contained within the stem. The tray (12) includes a pair of side flaps (36) which are folded into side rectangular tubes (44) to provide cushioning and lateral impact protection to the object (14). A pair of end flaps (38) enclose the object and are provided with access ports (30) permitting operation and programming of the component when it is contained within the tray (12).

16 Claims, 4 Drawing Sheets

UTILITY AND PROTECTIVE PACKAGING SYSTEM

The following claims priority from a provisional patent application, Ser. No. 60/785,762, filed 21 Mar. 2006 to the same inventors.

TECHNICAL FIELD

The present invention relates generally to storage and shipping packaging and more specifically to packaging for generally rectangular objects, particularly electronic gear such as electronic entertainment components, digital video recorders, cable control boxes, modems and video components.

BACKGROUND ART

Electronic components require protective packaging to minimize the risk of damage during shipping and storage, prior to delivery to a customer. Needs exist to provide economical, simple and environmentally friendly packaging, without degrading the quality of protection to the enclosed components.

Typical efforts have involved boxes with cushioning elements added to shield the contents from turbulence, impact and crushing damage. The cushioning elements have included "peanuts" of compressible plastic materials, shredded or crumpled newspapers, air-filled plastic backs and the like. These items can be effective but create handling problems both at the beginning and the end of the shipping chain. Storing and disposing of these items can be cumbersome and potentially environmentally unfriendly. In addition, in order to provide sufficient protection, the packaging is often unduly bulky and unwieldy.

Some types of components, such as digital video recorders (DVRs) and cable control boxes, require testing and custom programming between the manufacturing site and the end user. For example, a local cable provider may need to configure the programming of a DVR or cable box to fit local parameters prior to installing at a home. It can be problematical to remove the component from the shipping packaging, operate it and then either return it to packaging or leave it unprotected for the final shipment stages to the end user. Bulky and cumbersome conventional packaging solutions lead to lost time and wasted efforts, not to mention damaged components during unnecessary handling steps.

While some prior art systems have addressed some of the above noted concerns, none have suitably addressed them all, and today there remains a need for protective packaging systems for electronic components. Accordingly, a need remains for new approaches to protectively package components such as DVRs and the like which may require intermediate processing between the manufacturer and the end user, typically a home installation.

DISCLOSURE OF INVENTION

Accordingly, it is an object of the present invention to provide a system for protecting a component object from compression and impact damage during shipment and storage.

Another object of the invention of the present invention is to provide a unitary packaging structure, without the need for additional protective cushioning elements which must be disposed of after use.

A further object of the present invention is to provide an environmentally friendly utility and protective packaging system for relatively delicate electronic components.

Still another object of the invention is to provide packaging which permits in situ access to the operational portions of the object, such that testing, programming and other operational tasks may be performed without removing the component form the packaging.

Yet another object of the present invention is to provide a storage and transport packaging system which confirms to industry standards for protection and drop testing.

Briefly, one preferred embodiment of the present invention is a utility and protective packaging system particularly well adapted to store and transport electronic components, particularly those components which may need active handling at intermediate locations between manufacturer and end user. The preferred embodiment is a planar sheet member custom configured with dimensions and access ports configured to a particular component object. The planar sheet is precut to have a center panel, a pair of side flaps and a pair of end flaps which can be folded about an object to form an enclosing tray. The preferred tray includes side rectangular tubes formed by folding the side flaps, the rectangular tubes being hollow for receiving objects and for protecting the object against side impact and crushing. The tray is also self fastening with mating projections and apertures for receiving those projections to hold the tray together.

An advantage of the present invention is that the object is accessible while contained within the tray, such that maintenance, testing, programming and the like may be accomplished without removing or opening the packaging.

Another advantage of the present invention is that access ports may be custom provided in the packaging to conform to the needs of a particular component.

Still another advantage of the present invention is that the packaging system may be constructed as a planar sheet and shipped to the component manufacturer in a compact fashion.

A further advantage of the present invention is that the packaging system may be manufactured from environmentally friendly materials and is sufficient by itself to provide the protection to the object, thus avoiding the need for further cushioning materials.

Yet another advantage of the present invention is that it provides ready storage capacity for accessories, manuals and the like accompanying a component object.

Still another advantage of the present invention is that the tray is providing with convenient handling holes for easy grasping, both as an individual unit and in stacks.

These and other objects and advantages of the present invention will become clear to those skilled in the art in view of the description of the best presently known modes of carrying out the invention and the industrial applicability of the preferred embodiments as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
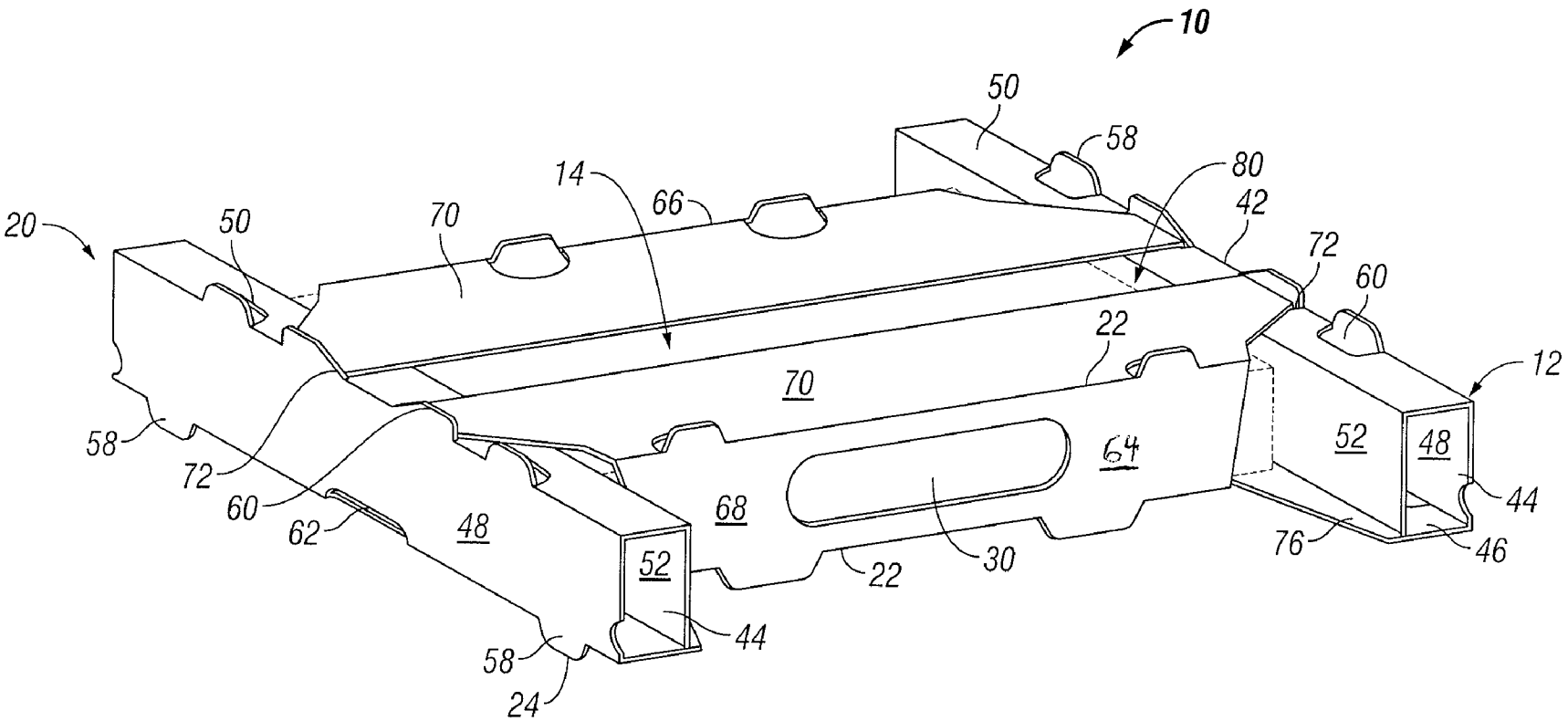
FIG. 1 is a perspective view of the utility and protective packaging system of the present invention, shown from the front and in the folded (object containing) mode, shown with a component object contained therewithin.

A preferred embodiment of the present invention is a utility and protective packaging system 10 which will, in ordinary use be configured into a tray 12 which is specifically adapted to enclose, confine and protect an object 14. The object 14 will ordinarily be a rectangular solid and will usually be an electronic component such as a DVR, cable system control box, computer blade component, stereo system component or the like. The packaging system 10 is illustrated in the various figures of the drawing and is described below in reference to such figures.

Figure 2:
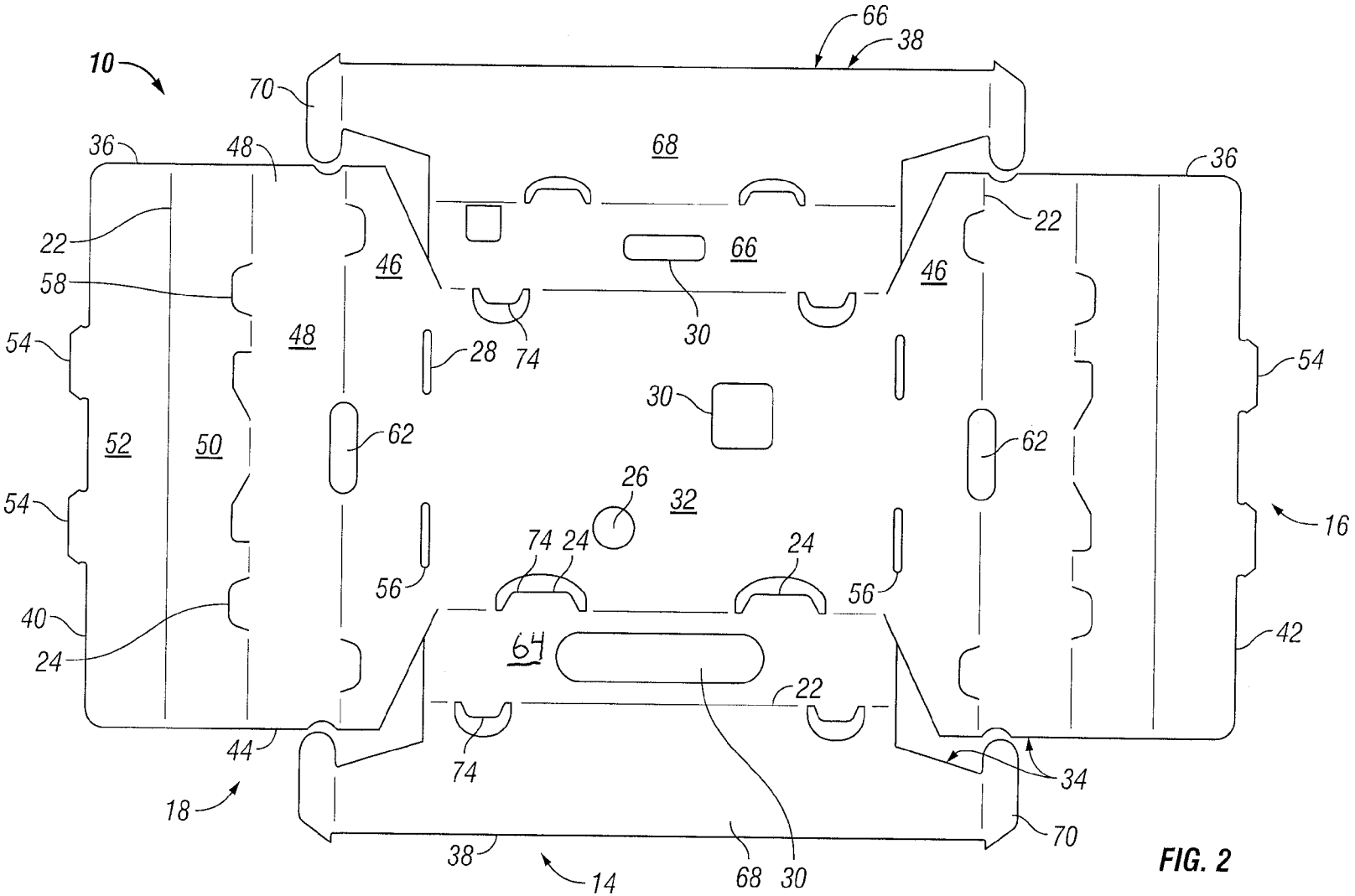
FIG. 2 is a plan view of the present invention, shown in its planar (pre-folding) mode.
Figure 3:
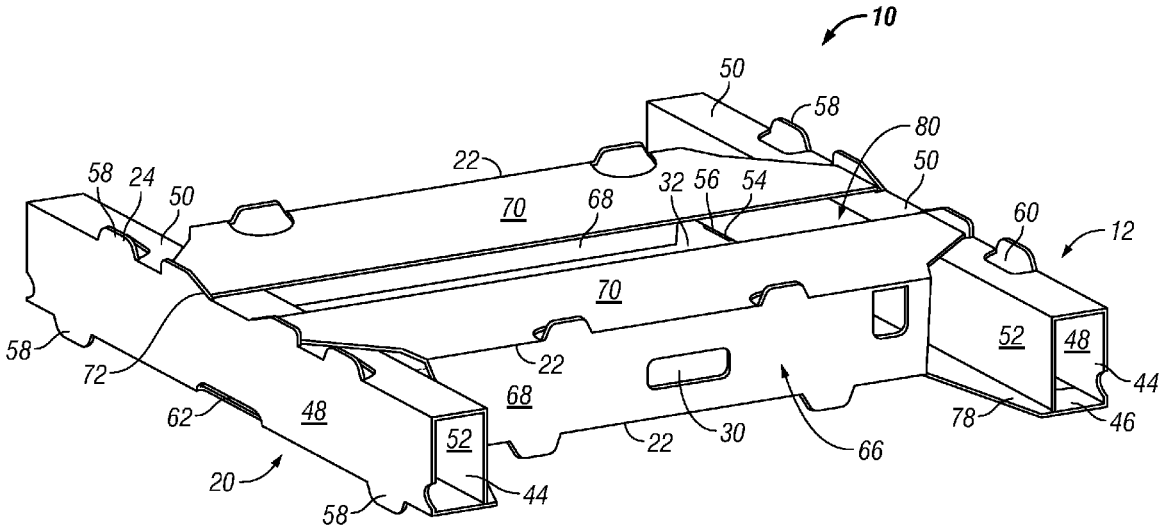
FIG. 3 is a further perspective view, similar to FIG. 1, of the present invention, shown from the rear.
Figure 4:
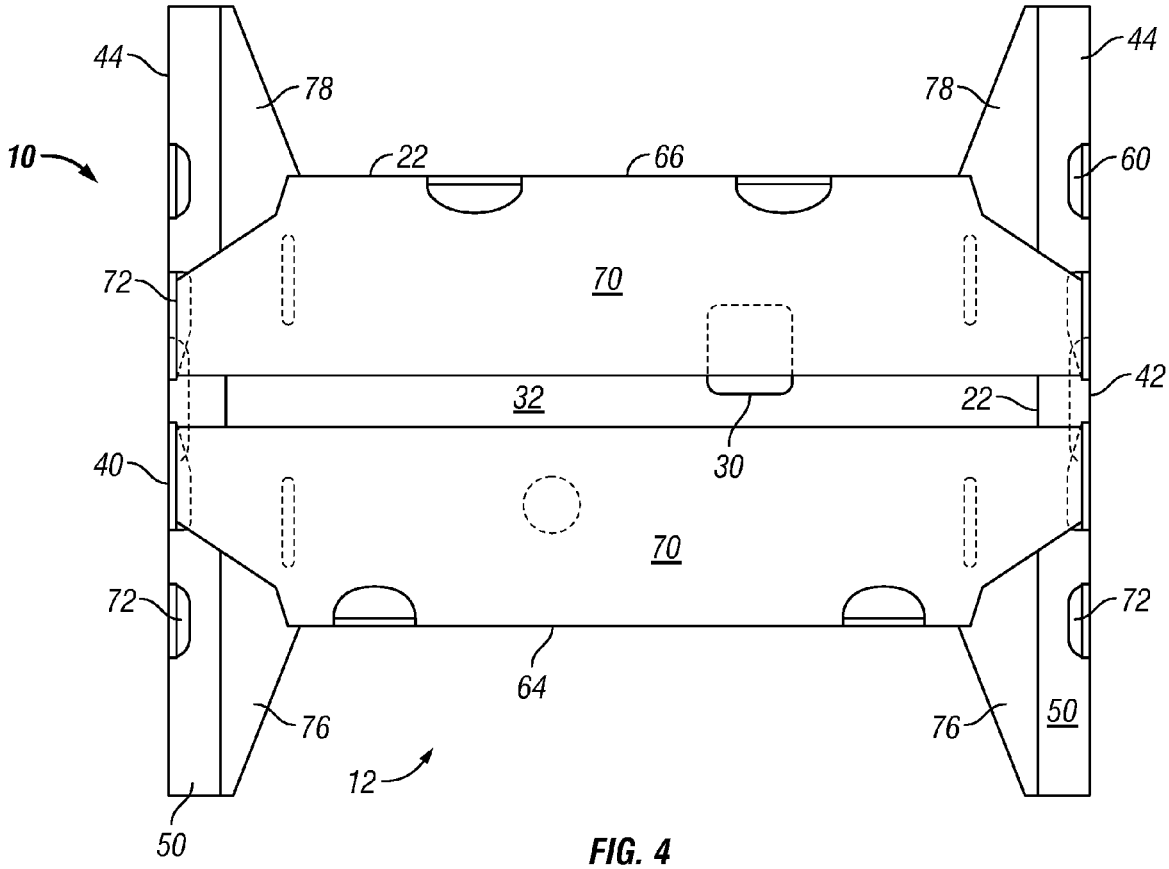
FIG. 4 is a top plan view of the system in the folded or tray mode.

The packaging system 10 begins its existence as a planar sheet 16 (see FIG. 2) formed of cardboard or similarly planar protective material, which has been precision cut and creased in order to be folded. The planar sheet 16 exists in a planar mode 18 prior to use (FIG. 2), where is may be stacked and shipped in elongated sheet form until put into use. When the object 14 is placed on the sheet, it may then be folded and frictionally fit ("snapped") into a folded mode or "tray mode" 20 (see FIGS. 1, 3 and 4), with the object 14 captured inside the tray 12.

In order to facilitate the conversion of the planar sheet 16 from the planar mode 18 to the tray mode 20, the planar sheet 16 is provided with a number of preformed folding creases 22 (all formed on the upper/interior surface of the planar sheet 16). Further various projections 24 with corresponding apertures 26 are formed for various purposes, as are some slots 28 and access ports 30, as will be discussed hereinafter.

The planar sheet 16 includes a center panel 32 in the approximate center thereof. The center panel 32 forms the "floor" upon which the object rests. Various extensions 34 (also known as "flaps") are formed extending outward from the center panel 32. These include a pair of opposing and generally symmetrical side flaps 36 and a pair of opposing and generally symmetrical end flaps 38 (with the orientation references being taken from the object 14 itself and the "end" referring to the front and rear of the object 14).

The side flaps 36 include a left side flap 40 and a right side flap 42. These are symmetrical and each includes a number of discreet portions, extending consecutively outward from the floor of the center panel 32. Each flap includes portions which fold to form a side rectangular tube 44.

Immediately extending from each side of the center panel 34 (and effectively being a part of that portion) is a base extension 46, which extends to a folding crease 22 where it becomes a side exterior panel 48, which extends to a folding crease 22 and becomes a side top panel 50, extending to anther folding crease 22 and finally becomes a side interior panel 52. Each folding crease 22 on a side flap 36 is parallel to each other and is formed on the same side of the material so the various portions fold inward to form the side rectangular tube 44. The integrity of the side rectangular tube 44 is maintained by a pair of flanged projections 54 extending therefrom to mate with a corresponding pair of receiving slits 56 formed at the juxtaposition of the center panel 34 and the base extension 46. The side interior panel 52 abuts against the object 14 in the tray mode 20 so as to hold the object securely in position.

The side exterior panel 48 also includes a plurality of side spacer projections 58, with corresponding projection apertures 60 on the respective base extension 46 and side top panel 50, formed at the folding creases 22 on each edge. The folding creases 22 are interrupted at the locations of the projections 24 and the shape of each projection 24 is cut so as to extend outward when the sheet 16 is folded. The side spacer projections 58 help maintain separation when multiples of the trays 12 are stored together.

The side rectangular tubes 44 have side exterior panels 50 and side interior panels 52 dimensioned to be slightly higher than the thickness of the object 14, in order that the tubes 44 extend slightly beyond the object 14 when the invention 10 is in tray mode 20. This permits the tubes 44 to minimize the potential for crushing impact on the object 14 during storage and transport. The tubes 44 also extend laterally substantially beyond the borders of the object 14. This provides drop protection when the tray 12 lands on edge.

A further aperture 26 is provided at the bottom center edge of each side exterior panel 48. This provides a handling hole 62. The entire tray may be easily gripped and handled by inserting hands or tools into the opposing handling holes 62.

The end flaps 38 include a front flap 64 and a rear flap 66. While very similar, these are not quite as symmetrical in a typical configuration as are the side flaps 36. This is because the end flaps 38 are custom configured for the particular object 14 to be contained. As the particular electronic component is likely to have differently placed power and signal connections on the rear surface, and different locations for controls and displays on the front surface, the corresponding flaps will look different and have the access ports 30 shaped and placed differently. Nonetheless, the particular portions will be similar and arrayed in the same order.

In the case of the end flaps 38, the centermost folding crease 22 is placed directly at the edge of the center panel 34, and an end panel 68 is adapted to fold upward directly adjacent to the object 14. Another folding crease 22 creates a demarcation between the end panel and an adjacent top overlap panel 70. The extreme side edges of the top overlap panels 70 are provided with tab projections 72. The tab projections 72 are adapted to mate with corresponding projection apertures 60 on the side top panels 50 in order to provide a relatively secure, releasable snap fit closure when the tray mode 20 is complete.

In the preferred embodiment 10, the top overlap panels 70 are narrower than one-half of the corresponding distance between the edges of the center panel. This means that the top overlap panels 70 of the front flap 64 and the rear flap 66 do not meet, but leave a significant gap therebetween. This facilitates ventilation and cooling of the component object 14 when it is operated while in the packaging system 10, since the typical object 14 will have ventilation holes on its top surface.

In a manner similar to the situation with the side flaps 36, the end panels 68 are provided with end spacer projections 74 which are exposed when the folds are accomplished. The end spacer projections 74 provide vertical protection to the object during storage and handling.

The side rectangular tubes 44 extend longitudinally well beyond the end panels 68. This gives the overall tray 20 the broad-stemmed capital "I" shaped appearance which inspired the BUTTERFLY™ trademark utilized in connection with the preferred embodiment. This shape provides significant protection from crushing impact to the front and rear surfaces of the object during transportation and storage. In order to provide structural support to the extended portions of the side rectangular tubes, the base extensions 46 are provided with front buttresses 76 and rear buttresses 78. In a typical arrangement, the front buttresses 76 are acute triangular extensions, while the rear buttresses 78 tend to be larger and less regular in shape in order to provide greater access to connections located near the rear edges of the component object 14.

When all of the flaps are fully engaged into the tray mode 20, they define, with the center panel, a cavity 80 for containing and securing the object 14. Typically, the cavity 80 is dimensioned to provide minimal sliding room for the object in order to minimize the potential for turbulence during transport.

One of the unique features of the present invention is that the electronic component object 14 may be operated and programmed while it is still contained in the packaging 10. This is due to the configuration of the tray 12 and the provision of custom placed access ports 30 corresponding to the access requirements of the particular component object 14. Since the positioning and dimensions of the access ports 30 are customized for each particular component object 14 to be contained within the tray, the particular arrangement depicted in the drawings is by way of example only. It is understood that the particular dimensions of the center panel 32 and the extensions 34 will also be customized for containing particular objects. Although there is a certain amount of conformity in the structure of electronic components there are enough variations that detailed shaping is required in each instance.

The usually preferred material for forming the packaging system is multilayer biodegradable cardboard. However, other suitable sheet materials, having appropriate cushioning properties and structural integrity, may be substituted.

While various embodiments have been described above, it should be understood that they have been presented by way of example only, and not as limitation.

INDUSTRIAL APPLICABILITY

The utility and protective packaging system 10 of the present invention is adapted first for applicability in shipping and storage situations and accessibility to the packaged object 14 while still within the packaging 10. The preferred packaging has access ports 30 which are custom configured to correspond to the contacts, signal connectors, displays, control buttons and power connectors on the particular object 14 to be enclosed in the cavity 80.

The packaging system 10 will be laid out and cut from sheet material to form the planar sheet 16 configured in accordance with the needs of the particular object 14 to be contained. Modern computerized cutting and pressing equipment is capable of relatively easily configuration to create whatever shapes, dimensions and folding creases are appropriate for a particular component. Ordinarily, the designer will only need to reset dimensions and the location of access ports to conform to whatever desired contents are expected. After manufacture, the planar sheet 16 is ordinary left in planar mode 18 and delivered to the assembly location particular to the object 14. The first step in assembly is then to place the object 14 on the center panel 32. The side flaps 36 are folded first, in either order. Folding on the appropriate folding creases 22, the side exterior panel 48 is folded at a right angle to the base extension 46 so it extends slightly above the top surface of the object 14. It is noted that this folding causes some side spacer projections 58 to extend below the surface of the base extension 46 and also forms the handling hole 62 in the center bottom. Folding the side top panel 50 another ninety degrees causes some side spacer projections 58 to protrude above the surface and uncovers some projection apertures 60 adjacent to the intersection of the side top panel and the side exterior panel. Finally, the third fold is made to cause the side interior panel 52 to extend back downward, parallel to the side exterior panel 48. The flanged projections 54 on the side interior panels 52 project through and engage with the receiving slits 56 formed at the intersection of the center panel 32 and the base extension 46. The mating between the flanged projections 54 and the receiving slits 56 secures the structure together to form the side rectangular tube 44, which is hollow throughout its length. The side interior panels 52 effectively abut against the side surfaces of the object 14.

Once the side flaps 36 have been secured the end flaps 38 may be folded (in either order). The end panels 68 are folded at a right angle to the center panel 34 so that they effectively abut against the end (front and back) surfaces of the object 14 and extend slightly above the top surface of the object 14, exposing end spacer projections 74 extending below the surface of the center panel 34. It is noted that the access ports 30 on the end panels 68 are aligned with various controls, displays and connectors of the particular object 14 in order to facilitate access to those areas. The top overlap panels 70 are folded at right angles to the end panels 68, exposing end spacer projections 74 at the fold line 22. The opposing top overlap panels 70 extend partially across the top surface of the object 14, leaving a gap to permit ventilation. The tab projections 72 extend to, and are folded down to mate with, corresponding projection apertures 60 on the side top panels 52 of the side flaps 36. This engagement completes the enclosure of the tray 12 about the object 14 and effectively contains the object securely within the packaging system 10.

The side rectangular tubes 44 are hollow and open from each end thereof and provide effective locations for storing cords and other accessories needed for operation of the component object 14. Larger generally planar accessories, such as manuals, may be stored on top of the object 14 while being frictionally retained beneath the top overlap panels 70.

The assembled tray 12 remains intact until the assembly is delivered to the end user. During shipping, the tray 12 may be easily handled by using the handling holes to grasp either side of the tray 12. The spacer projections 24 minimize pressure and contact with items (such as another tray) "vertically" adjacent wile the extension of the side rectangular tubes 44 beyond the boundaries of the object 14 in all lateral direction minimizes lateral impact. The side tubes 44 also provide compression resistance from lateral directions.

It is intended and contemplated that interim procedures, such as testing, programming and the like will be required intermediate the packaging and the delivery to the ultimate user. The packaging system 10 facilitates this by making all necessary portions of the object 14 accessible while the integrity of the tray 12 is maintained. Power and connector cords may be removed from the side rectangular tube 44 and the connections may be made through the access ports 30 and exposed areas, via the rear buttresses 78, of the rear surface of the object 14. The controls and displays on the front surface are also accessible via the access ports 30 and the exposure provided by the front buttresses 76. Thus the programming and testing may be made without removing the object 14 from the tray 12. It is also noted that access ports 30 in the center panel 34 provide access to bottom surface items, such as labeling, battery hatches, bar codes and the like.

Once the item is finally delivered to the end user, the tray 12 may be disassembled by removing the tab projections 72 from the corresponding projection apertures 60, removing the object 14 from the cavity and collapsing the tray by removing the flanged projections 54 from the receiving slits 56. The packaging system 10 may then be returned to its planar configuration 18 or compactly folded for easy disposal. Since the selected material is ordinarily recyclable cardboard, disposal is not unduly harmful to the environment.

The unitary nature of the packaging provides excellent efficiency and convenience for the manufacturer. Once the object 14 is placed within the tray 12, it is provided with durable, inexpensive and environmentally friendly protection until it reaches the end user. The accessibility to the object, replete with protection, permits handling, testing and programming during the transit to the user. The inventive utility and protective packaging system 10 provides many significant advantages at each step of the process of getting a component from the manufacturer to the end user.

For the above, and other, reasons, it is expected that the utility and protective packaging system of the present invention will have widespread industrial applicability. Therefore, it is expected that the commercial utility of the present invention will be extensive and long lasting.

We claim:

1. A utility and protective packaging system for generally rectangular solid objects, comprising:

a particular selected solid object having active areas on the front and rear surfaces thereof;

a planar sheet of packaging material adapted to have a planar mode and a folded mode for enclosing and protecting the solid object, said planar sheet being cut and creased to form;

a center panel;

a pair of side flaps, each being adapted to be folded into a hollow rectangular tube abutting against the side of the object;

a front flap adapted to fold over and abut against the front surface of said object; and a rear flap adapted to fold over and abut against the rear surface of the object;

wherein said front flap and said rear flap are provided with access ports specially corresponding to said active areas on said selected solid object to facilitate connection and operation of the object when contained within the packaging system in folded mode.

2. The utility and protective packaging system of claim 1, wherein said side flaps include handling openings formed to facilitate grasping and lifting when in folded mode.

3. The utility and protective packaging system of claim 1, wherein said hollow rectangular tube is open to each end to facilitate insertion of items.

4. The utility and protective packaging system of claim 1, and further including flanged projections on said side flaps adapted to mate with receiving slits to secure said rectangular tubes into shape; and tab projections on said end flaps adapted to mate with projection apertures to secure said end flaps in position to complete an object enclosing cavity.

5. The utility and protective packaging system of claim 1, and further including spacer projections extending outward from said side flaps.

6. The utility and protective packaging system of claim 1, wherein said side flaps extend laterally beyond the extent of said center panel and buttresses extend from said center panel to said side flaps.

7. A protective packaging system for use in combination with an electronic component, comprising:

an electronic component having connectors, displays and controls on its surfaces;

a sheet of planar material which is created in a planar mode and is custom cut and provided with folding creases in order to be configured into a folded mode into a tray for enclosing said electronic component; wherein a plurality of access ports are provided in said planar material to particularly correspond with said connectors, displays and controls on said electronic component such that said electronic component may be fully operated while said electronic component is enclosed within the protective packaging.

8. The protective packaging system of claim 7, wherein:

said sheet of planar material includes a center panel, a pair of opposed side flaps extending from opposite sides of said center panel, a front flap extending from said center panel and a rear flap extending from said center panel.

9. The protective packaging system of claim 8, wherein:

each said side flap includes a base extension portion extending in a coplanar fashion from said center panel, a side exterior panel folded at a right angle from the plane of said base extension portion, a side top panel folded inward at a right angle from said side exterior panel and a side interior panel folded downward from said side top panel to form a rectangular tube with said base extension portion, said side exterior panel and said side top panel.

10. The protective packaging system of claim 9, wherein:

said base extension portion, said side exterior panel, said side top panel and said side interior panel are wider than said center panel such that said rectangular tube extends laterally beyond said center panel.

11. The protective packaging system of claim 9, wherein:

each said side exterior panel includes a handling hole cutout in the center thereof adjacent to said base extension.

12. The protective packaging system of claim 8, wherein:

said front flap includes an end panel folded upward at a right angle from said center panel and a top overlap panel folded inward from said end panel for extending over a portion of said electronic component.

13. The protective packaging system of claim 8, wherein:

said rear flap includes an end panel folded upward at a right angle from said center panel and a top overlap panel folded inward from said end panel for extending over a portion of said electronic component.

14. The protective packaging system of claim 9, wherein:

said front flap includes an end panel folded upward at a right angle from said center panel and a top overlap panel folded inward from said end panel for extending over a portion of said electronic component; and said rear flap includes an end panel folded upward at a right angle from said center panel and a top overlap panel folded inward from said end panel for extending over a portion of said electronic component.

15. The protective packaging system of claim 14, wherein:

said base extension portion, said side exterior panel, said side top panel and said side interior panel are wider than said center panel such that said rectangular tube extends laterally beyond said center panel.

16. The protective packaging system of claim 14, wherein:

flanged projections are formed on each said side interior panels to mate with receiving slits formed at the intersection of said center panel and said base extension portion; and tab projections are formed on the edges of each said top overlap portions to mate with projection apertures formed on corresponding side top panels.

* * * * *